US011758977B2

(12) United States Patent
Sudo et al.

(10) Patent No.: US 11,758,977 B2
(45) Date of Patent: Sep. 19, 2023

(54) SOLE AND BASEBALL SPIKE SHOE WITH THE SOLE

(71) Applicant: MIZUNO CORPORATION, Osaka (JP)

(72) Inventors: Shingo Sudo, Osaka (JP); Shogo Matsui, Osaka (JP); Kohei Mimura, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 17/377,677

(22) Filed: Jul. 16, 2021

(65) Prior Publication Data

US 2022/0031020 A1 Feb. 3, 2022

(30) Foreign Application Priority Data

Jul. 31, 2020 (JP) ..... 2020-130777

(51) Int. Cl.
*A43B 13/26* (2006.01)
*A43B 5/00* (2022.01)

(52) U.S. Cl.
CPC ..... *A43B 13/26* (2013.01); *A43B 5/00* (2013.01)

(58) Field of Classification Search
CPC ..... A43B 13/26; A43B 13/223; A43B 13/04; A43B 5/00; A43C 15/162
See application file for complete search history.

(56) References Cited

U.S. PATENT DOCUMENTS 3,040,450 A * 6/1962 Phillips ..... A43C 15/162 264/261
4,316,335 A * 2/1982 Giese ..... A43B 5/00 36/129
4,527,344 A * 7/1985 Mozena ..... A43C 13/04 36/134

(Continued)

FOREIGN PATENT DOCUMENTS

JP 2006272093 A 10/2006
JP 2009285341 A 12/2009
JP 2014124401 A 7/2014

OTHER PUBLICATIONS

Blitzresults. Shoe Width Guide: Size Charts + How to Measure at Home. https://www.blitzresults.com/en/shoe-size-width/#chart (Year: 2022).*

*Primary Examiner* — Bao-Thieu L Nguyen
(74) *Attorney, Agent, or Firm* — TROUTMAN PEPPER HAMILTON SANDERS LLP; James E. Schutz; Korbin Blunck

(57) ABSTRACT

An object of the present invention is to provide a sole of a baseball spike shoe that improves a ball speed in a pitching motion. A sole includes a plurality of first protrusions arranged in a forefoot region of a sole body. Each of the first protrusions is formed such that its longitudinal direction extends along a foot width direction in a bottom view. When the plurality of first protrusions are projected on a virtual projection plane as viewed from a front side of the sole body, the sum of projection lengths of the plurality of first protrusions in the foot width direction is 85% or more and 100% or less of a distance of a straight line connecting in the foot width direction a side of the most medial first protrusion to a side of the most lateral first protrusion.

4 Claims, 13 Drawing Sheets

(56) References Cited

U.S. PATENT DOCUMENTS 4,590,693 A * 5/1986 Kawashima ..... A43C 15/162 36/134
5,351,421 A * 10/1994 Miers ..... A43B 13/26 D2/951
5,628,129 A * 5/1997 Kilgore ..... A43C 15/162 36/134
6,557,270 B2 * 5/2003 Nakano ..... A43B 5/02 36/28
6,807,752 B2 * 10/2004 Nakano ..... A43B 5/00 36/28
6,810,605 B2 * 11/2004 Nakano ..... A43B 13/26 36/28
9,149,088 B2 * 10/2015 Minami ..... A43C 15/02
9,173,450 B2 * 11/2015 Minami ..... A43C 15/161
2003/0177666 A1 * 9/2003 Nakano ..... A43B 5/001 36/102
2003/0192199 A1 * 10/2003 Nakano ..... A43B 5/02 36/25 R
2008/0313932 A1 * 12/2008 Langvin ..... A43C 15/02 36/30 R
2010/0257756 A1 * 10/2010 Chang ..... A43C 15/162 36/59 R
2011/0247243 A1 * 10/2011 Eder ..... A43C 15/164 36/67 A
2013/0061498 A1 * 3/2013 Droege ..... A43B 5/00 36/25 R
2013/0067778 A1 * 3/2013 Minami ..... A43C 15/162 36/59 R
2014/0123522 A1 * 5/2014 Rustam ..... A43C 15/16 36/25 R
2014/0259786 A1 * 9/2014 Heard ..... A43B 13/16 36/103
2015/0068063 A1 * 3/2015 Farris ..... A43C 15/162 36/103
2016/0135540 A1 * 5/2016 Smith ..... A43B 13/22 36/59 R
2018/0125169 A1 * 5/2018 Hirai ..... A43B 5/00
2021/0345726 A1 * 11/2021 To'oto'o ..... A43B 5/185
2021/0361033 A1 * 11/2021 Ellera Gomes ..... A43C 15/162

* cited by examiner

SOLE AND BASEBALL SPIKE SHOE WITH THE SOLE

CROSS-REFERENCE TO RELATED APPLICATION

This application claims priority to Japanese Patent Application No. 2020-130777 filed on 31 Jul. 2020, the entire disclosure of which is incorporated by reference herein.

BACKGROUND

The present disclosure relates to a sole and a baseball spike shoe including the sole.

A pair of shoes has been proposed by Japanese Unexamined Patent Application No. 2014-124401, for example, as baseball spike shoes suitable for a pitching motion of a pitcher.

Japanese Unexamined Patent Application No. 2014-124401 discloses a pair of baseball spike shoes including a plurality of metal spikes arranged on a lower surface of an outsole at positions corresponding to a forefoot. The shape and arrangement of the spikes of the baseball spike shoes are determined in consideration of an engaging force between the pitcher's pivot foot and the ground with which the pivot foot is in contact.

SUMMARY

In general, a grip force of the baseball spike shoes with respect to the ground is an important factor for improving a ball speed in the pitching motion. In particular, when a foot opposite to a pitching arm (hereinafter referred to as a "lead foot") steps on the ground, it is desirable to increase the grip force of the shoe applied to the lead foot in consideration of the relationship between a region of the sole of the shoe corresponding to the forefoot of the lead foot and a shear component of a floor reaction force acting on the region in order to improve the ball speed.

However, in the baseball spike shoes of Japanese Unexamined Patent Application No. 2014-124401, as described above, the shape and arrangement of the plurality of spikes are merely determined in consideration of the engaging force between the pivot foot of the pitcher (the foot on the same side as the dominant arm pitching the ball) and the ground when the pivot foot steps on the ground. That is, the shoes have been made without any consideration of the relationship between the region of the sole of the shoe corresponding to the forefoot of the lead foot and the shear component of the floor reaction force acting on the region. For this reason, the above-described shoes were not able to obtain a sufficient grip force of the lead foot, and could not contribute to the improvement of the ball speed in the pitching motion.

The present disclosure has been made in view of the foregoing background, and an object of the present disclosure is to improve a ball speed in a pitching motion.

To achieve the object, a first aspect of the present disclosure is directed to a sole of a baseball spike shoe applicable to a foot opposite to a pitching arm. The sole includes: a sole body; and a plurality of first protrusions each of which is more rigid than the sole body and configured to protrude downward from the sole body. The plurality of first protrusions are arranged in a forefoot region of the sole body corresponding to a forefoot of a wearer's foot. Each of the first protrusions is formed such that its longitudinal direction extends along a foot width direction in a bottom view. When the plurality of first protrusions are projected on a virtual projection plane as viewed from a front side of the sole body, a sum of projection lengths of the plurality of first protrusions in the foot width direction is 85% or more and 100% or less of a distance of a straight line connecting in the foot width direction a side of the most medial one of the first protrusions to a side of the most lateral one of the first protrusions.

According to the first aspect, when the foot opposite to the dominant arm pitching the ball (lead foot) steps on the ground, the plurality of first protrusions arranged densely in the foot width direction receive most of the shear component of the floor reaction force acting on the sole applied to the lead foot. Thus, the shear component of the floor reaction force acting on the forefoot region increases in the sole applied to the lead foot. This can increase the grip force of the lead foot with respect to the ground. Thus, according to the first aspect, the ball speed in the pitching motion can be improved.

A second aspect of the disclosure is an embodiment of the first aspect. In the second aspect, each of the first protrusions is configured such that the longitudinal direction is inclined at an angle in a range of 80 degrees or more to 100 degrees or less with respect to a foot length direction in a bottom view.

In the second aspect, with the longitudinal direction of the first protrusions extending substantially along the foot width direction, the front surfaces of the first protrusions easily face toward the front side of the sole body. Therefore, when the lead foot steps on the ground, the plurality of first protrusions efficiently receive the shear component of the floor reaction force. As a result, the shear component of the floor reaction force acting on the forefoot region increases on the sole applied to the lead foot, which can further increase the grip force.

A third aspect of the disclosure is an embodiment of the first or second aspect. In the third aspect, the most medial first protrusion is arranged near a position corresponding to a thenar eminence of the wearer's foot in the forefoot region, and the most lateral first protrusion is arranged near a position corresponding to a hypothenar eminence of the wearer's foot in the forefoot region.

According to the third aspect, the grip force at the positions corresponding to the thenar eminence and hypothenar eminence of the wearer's foot in the forefoot region can be increased. In addition, when the lead foot steps on the ground, the sole can be stabilized in the foot width direction with the first protrusions located at the positions each corresponding to the thenar eminence and hypothenar eminence of the wearer's foot in the forefoot region serving as fulcrums.

A fourth aspect of the disclosure is an embodiment of any one of the first to third aspects. In the fourth aspect, each of the plurality of first protrusions is made of a metal material or a ceramic material.

According to the fourth aspect, the first protrusions made of a metal material or a ceramic material ensure relatively high rigidity. Thus, when the lead foot steps on the ground, the plurality of first protrusions easily stick into the ground, and the sole can be stabilized with respect to the ground.

A fifth aspect of the disclosure is an embodiment of any one of the first to fourth aspects. In the fifth aspect, each of the plurality of first protrusions has a plate shape, and is configured such that its front surface faces toward the front side of the sole body.

According to the fifth aspect, when the lead foot steps on the ground, the plurality of first protrusions efficiently receive the shear component of the floor reaction force. This can increase the shear component of the floor reaction force acting on the forefoot region, and can further increase the grip force.

A sixth aspect of the disclosure is an embodiment of any one of the first to fifth aspects. In the sixth aspect, the foremost one of the first protrusions is arranged at a position corresponding to a tiptoe of the wearer's foot in the forefoot region.

According to the sixth aspect, the first protrusion arranged at a position corresponding to the tiptoe of the wearer's foot receives the shear component of the floor reaction force from a point of time when the lead foot starts to step on the ground. This can increase the shear component of the floor reaction force acting on the forefoot region, and can further increase the grip force.

A seventh aspect of the disclosure is directed to a baseball spike shoe including the sole of any one of the first to sixth aspects.

In the seventh aspect, a baseball spike shoe that exhibits the same advantages as those of the first to sixth aspects can be obtained.

As described above, the present disclosure can improve the ball speed in the pitching motion.

DETAILED DESCRIPTION

Embodiments of the present disclosure will be described in detail with reference to the drawings. The following description of the embodiments is merely exemplary in nature, and is not intended to limit the scope, applications, or use of the present disclosure.

Figure 1:
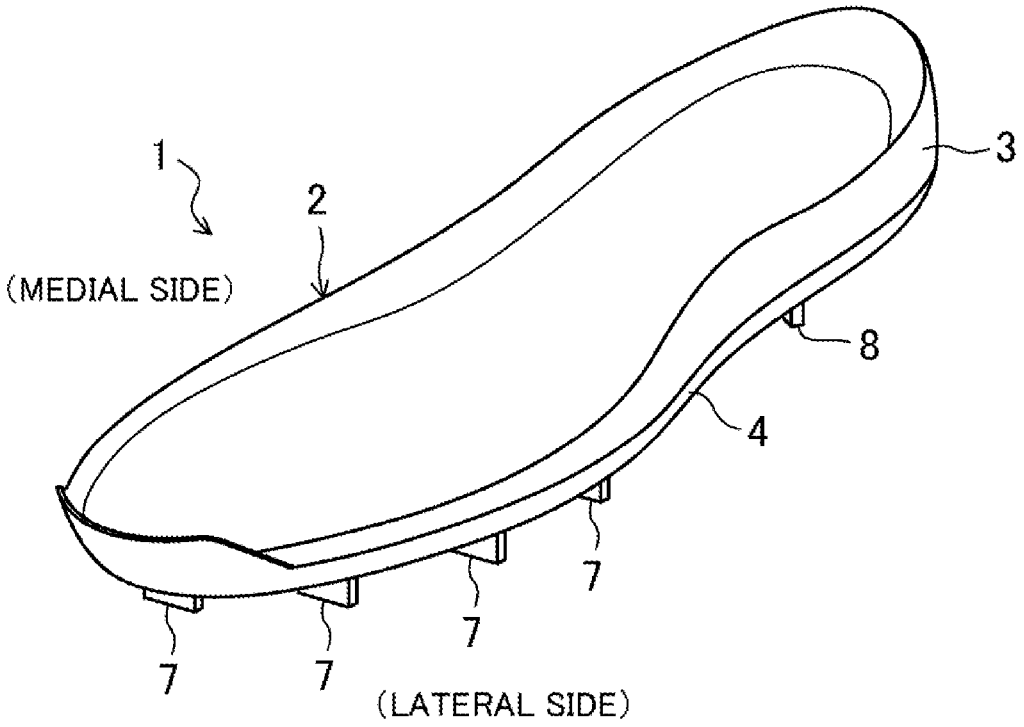
FIG. 1 is an overall perspective view illustrating a sole according to an embodiment of the present disclosure.
Figure 2:
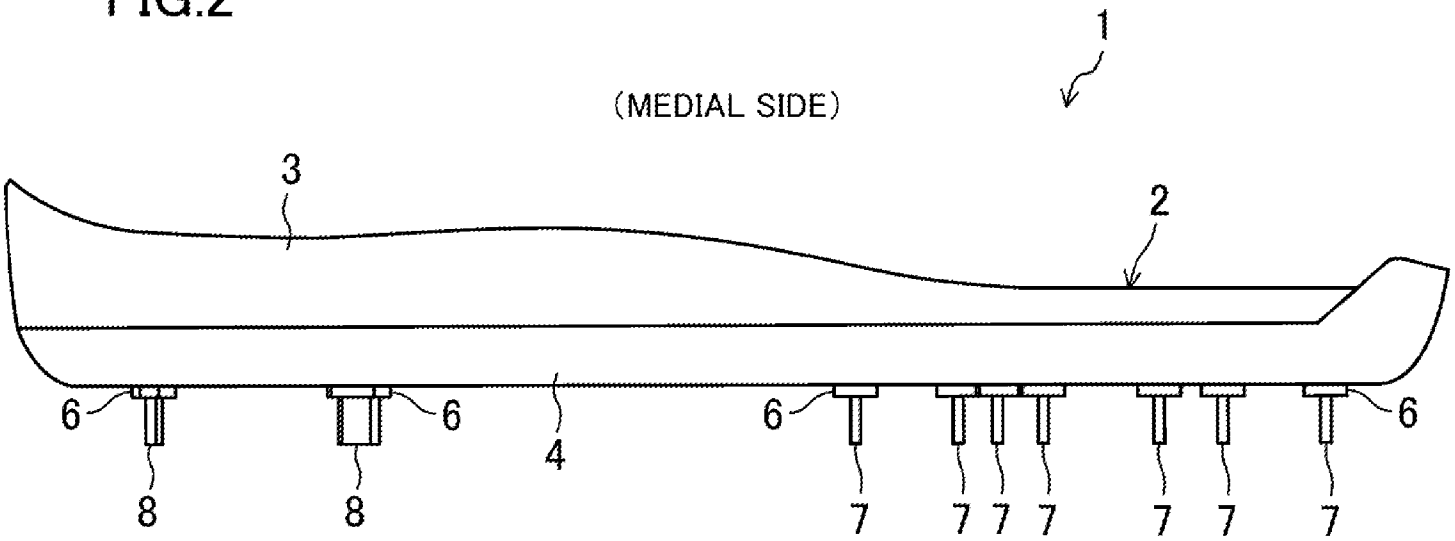
FIG. 2 is a side view illustrating the sole as viewed from above on the medial side.
Figure 3:
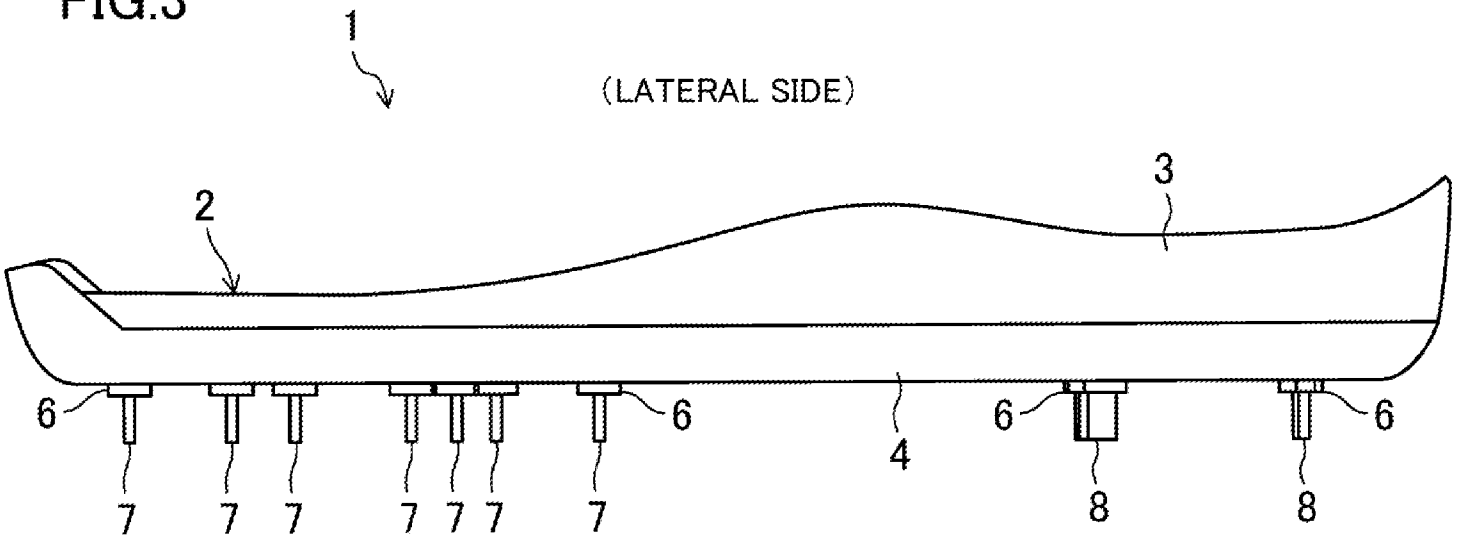
FIG. 3 is a side view illustrating the sole as viewed from above on the lateral side.
Figure 4:
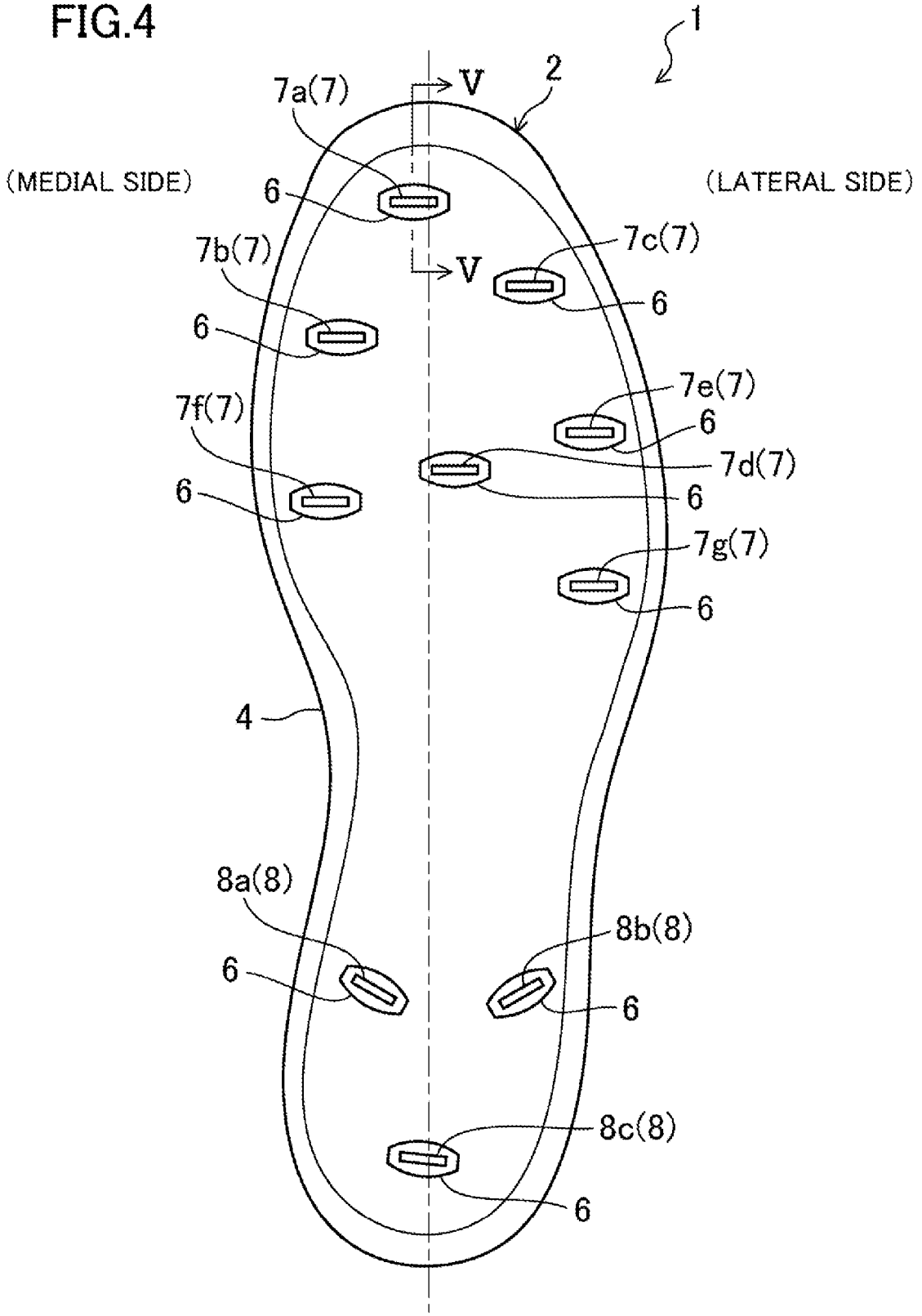
FIG. 4 is a bottom view of the sole.
Figure 12:
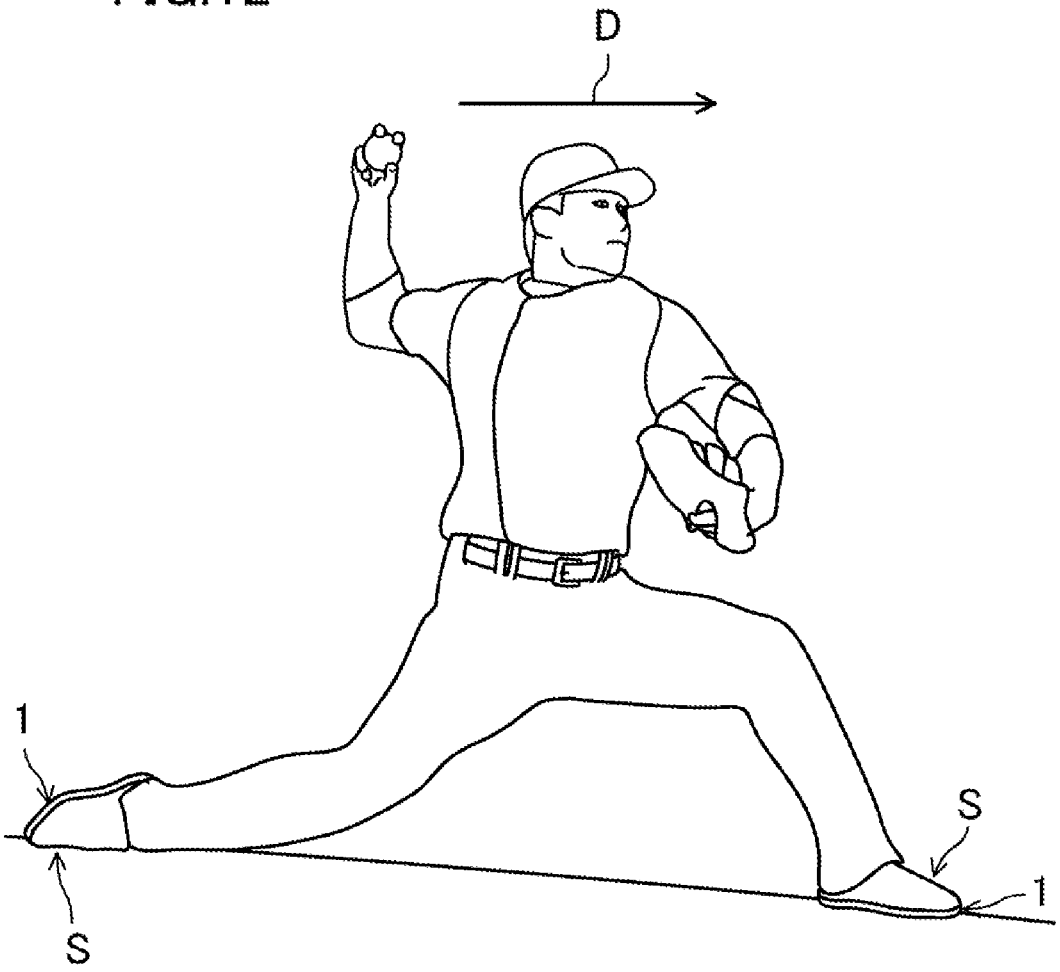
FIG. 12 is a schematic view illustrating a pitcher wearing the shoes according to the embodiment of the present disclosure in an initial phase of a pitching motion.

FIGS. 1 and 4 are general views illustrating a sole 1 according to an embodiment of the present disclosure. The sole 1 is a member for supporting a plantar of a wearer. As shown in FIG. 12, a baseball spike shoe S including the sole 1 is particularly suitable for a foot (e.g., a left foot, hereinafter referred to as a "lead foot") opposite to a pitching arm (e.g., a right arm). The shoe S includes an upper 20 that covers the foot of the wearer as shown in FIG. 12. Note that the shoe S is not limited to the lead foot, and is also applicable to a foot opposite to the lead foot (a pivot foot of a player pitching a ball).

In the embodiment of the present disclosure, the drawings show the sole 1 for the left shoe only. A sole for a right shoe is symmetrical to the sole 1 for the left shoe. Thus, only the sole 1 for the left shoe will be described in the following description, and the description of the sole for the right shoe will be omitted herein.

In the following description, the expressions "upper," "upward," "on a/the top of," "lower," and "downward," represent the vertical positional relationship between respective components of the shoe S. The expressions "front," "fore," "forward," "rear," and "hind" represent the positional relationship in a foot length direction (front-rear direction) between respective components of the shoe S. The expressions "medial side" and "lateral side" represent the positional relationship in a foot width direction between respective components of the shoe S. The "foot length direction" refers to a direction parallel to a straight line connecting the front end and rear end of an outsole 4 together (see the chain line shown in FIG. 4).

Further, in the following description, the term "forefoot" refers to a portion of the wearer's foot ranging from a tiptoe to distal heads of the first to second metatarsal bones MT1 to MT5 in the foot length direction (see FIG. 10). The "midfoot" refers to a portion of the wearer's foot excluding the forefoot and a hindfoot in the foot length direction. The "hindfoot" refers to a portion of the wearer's foot corresponding to the calcaneus HL in the foot length direction.

Further, a "forefoot region F" refers to a region of a sole body 2 described later corresponding to the forefoot of the wearer's foot. A "midfoot region M" refers to a region of the sole body 2 corresponding to the midfoot of the wearer's foot. A "hindfoot region H" refers to a region of the sole body 2 corresponding to the hindfoot of the wearer's foot.

(Sole Body)

As shown in FIGS. 1 to 4, the sole 1 has a sole body 2. The sole body 2 includes a midsole 3 and an outsole 4.

The midsole 3 is stacked on the top of the outsole 4 with, for example, an adhesive. The midsole 3 is made of a soft elastic material which is less rigid than the outsole 4. Specifically, non-limiting examples of the material suitable for the midsole 3 include thermoplastic synthetic resins such as an ethylene-vinyl acetate copolymer (EVA) and foams thereof, thermosetting resins such as polyurethane (PU) and foams thereof, and rubber materials such as butadiene rubber and chloroprene rubber and foams thereof. The midsole 3 preferably has hardness of, for example, 15C to 65C on the Asker C scale.

The outsole 4 is made of a hard elastic member having greater hardness than the midsole 3. Specifically, non-limiting suitable examples of the material for the outsole 4 include thermoplastic resins such as polyamide-based resins, resins such as polyurethane (PU) and nylon-based elastomers, and rubber materials such as synthetic rubber and natural rubber. The outsole 4 preferably has hardness of, for example, 50A to 80A on the Asker A scale.

Figure 5:
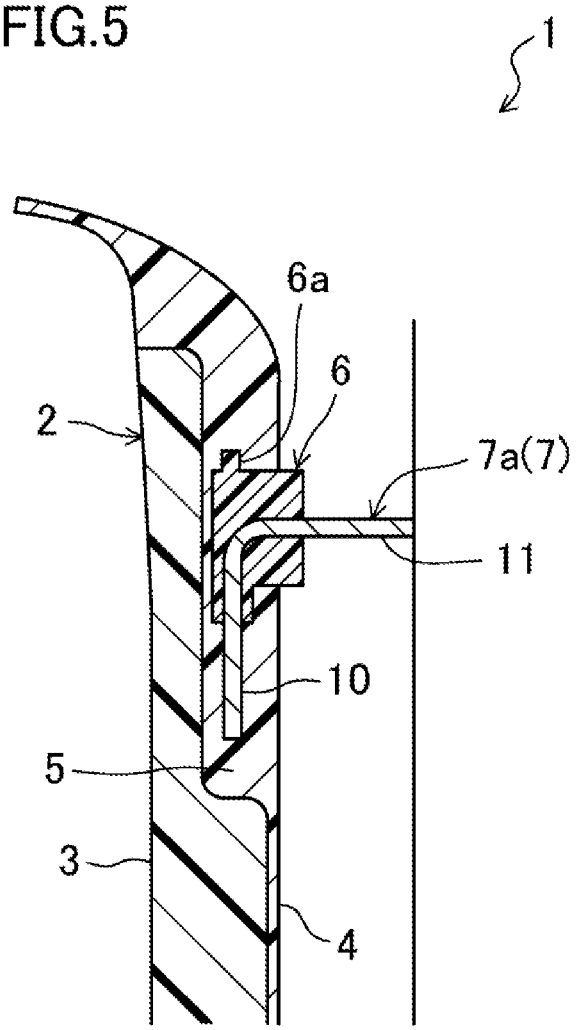
FIG. 5 is a cross-sectional view taken along line V-V of FIG. 4.
Figure 6:
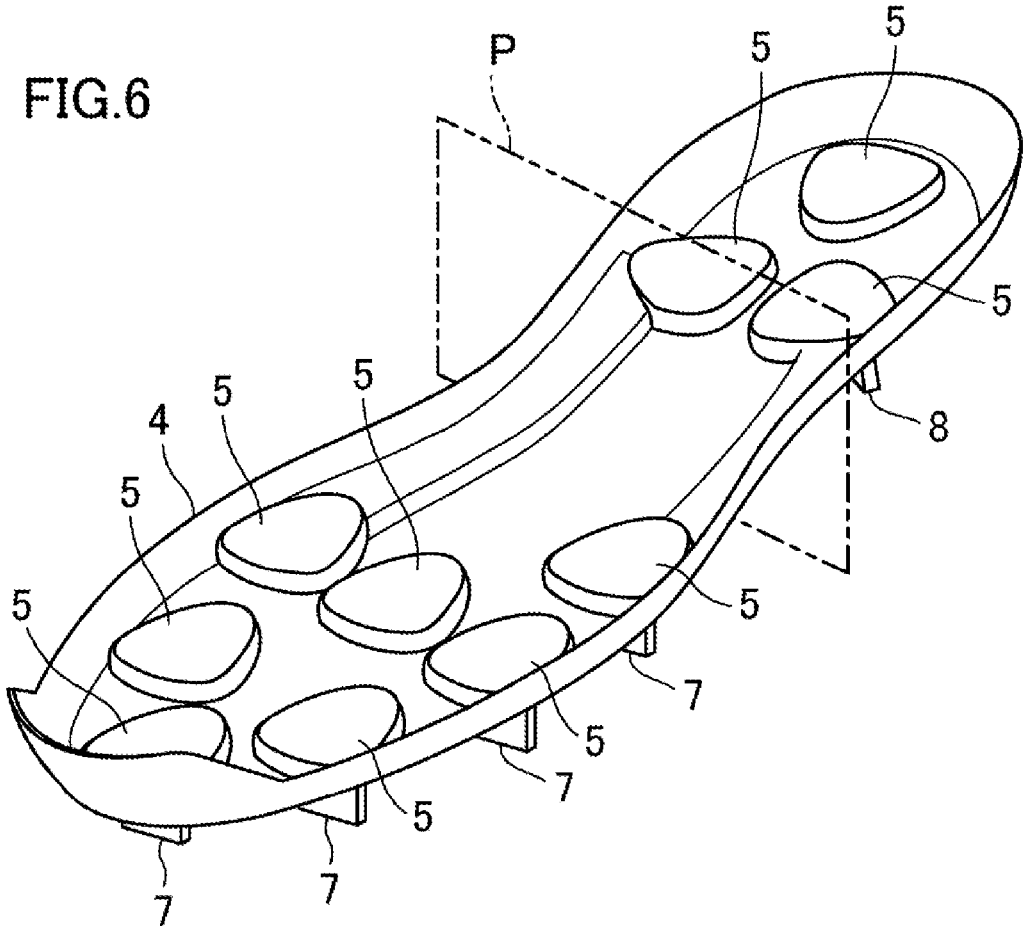
FIG. 6 is an overall perspective view illustrating an outsole and first and second protrusions.
Figure 7:
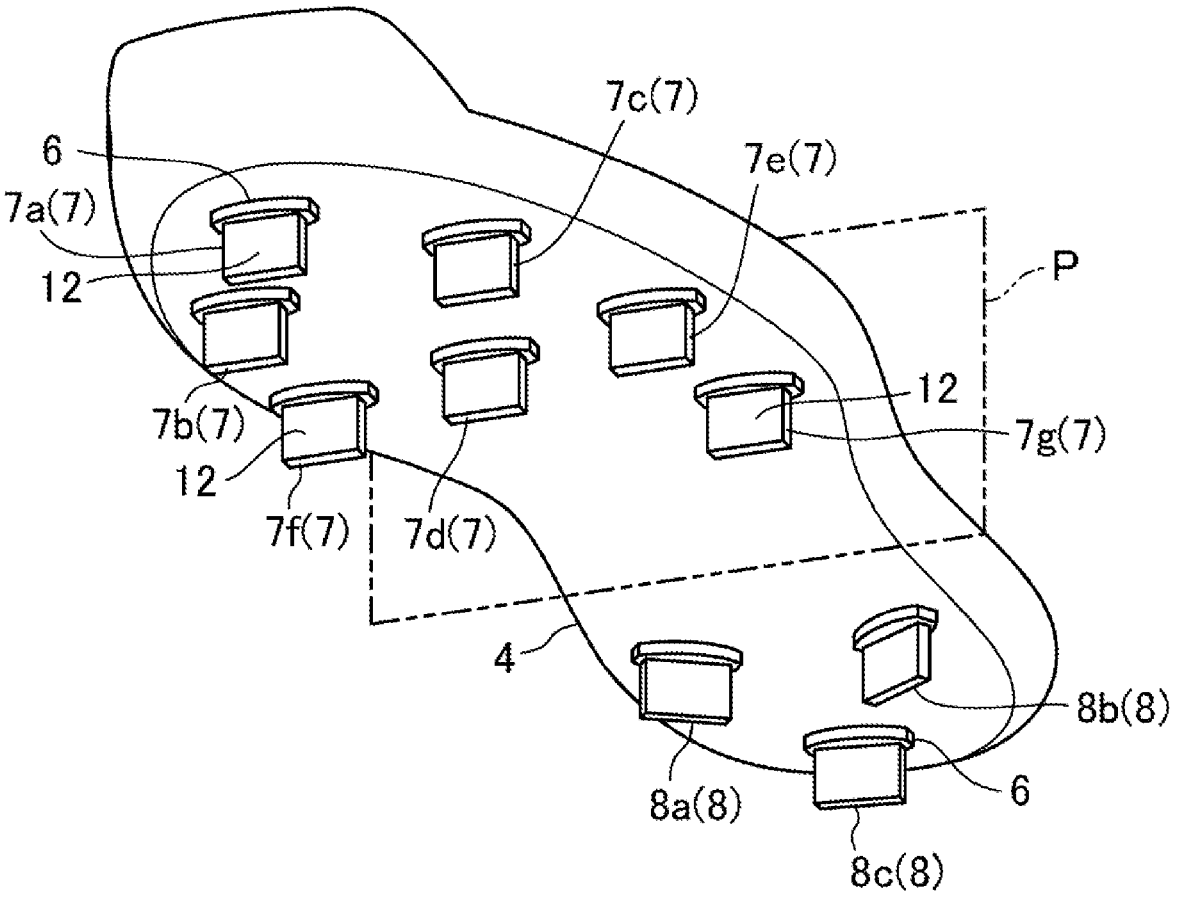
FIG. 7 is a perspective view illustrating the outsole and the first and second protrusions as viewed from below.

As shown in FIGS. 5 and 6, the outsole 4 has a plurality of mounts 5 protruding upward from an upper surface of the outsole 4. Each of the plurality of mounts 5 has a substantially triangular shape in plan view. The mounts 5 are arranged at positions corresponding to the forefoot region F and hindfoot region H of the outsole 4.

(Support Member)

As shown in FIGS. 2 to 5 and 7, the outsole 4 has a plurality of support members 6. The support members 6 are members for supporting first and second protrusions 7 and 8 described later immovably with respect to the outsole 4. The support members 6 are made of, for example, the same material as the outsole 4.

As shown in FIG. 5, each of the support members 6 is integrated with an associated one of the first and second protrusions 7 and 8 described later by, for example, injection molding. A lower portion of the support member 6 is exposed to the outside from the lower surface of the outsole 4, and a portion other than the lower portion is embedded in the mount 5.

Figure 8:
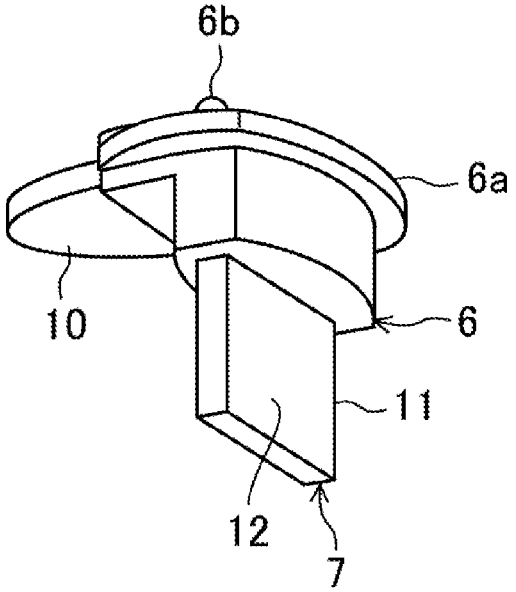
FIG. 8 is a perspective view as viewed from below, illustrating a support member and the first protrusion (or the second protrusion) integrated together.
Figure 9:
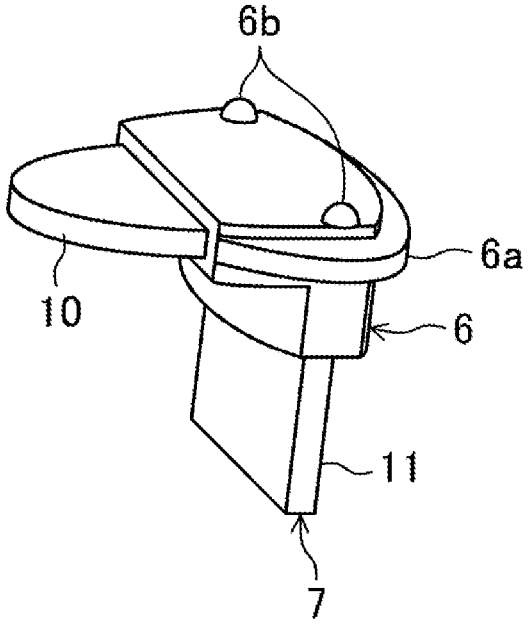
FIG. 9 is a perspective view as viewed from above, illustrating the support member and the first protrusion (or the second protrusion) integrated together.

As shown in FIGS. 8 and 9, the support member 6 of the present embodiment has a substantially L-shape in side view. A substantially plate-shaped peripheral portion 6*a* is provided on the upper peripheral edge of the support member 6. A plurality of (two in the illustrated example) projections 6*b* are provided on the upper surface of the support member 6 of the present embodiment. The projections 6*b* project upward from the upper surface of the support member 6 in a hemispherical shape. The peripheral edge portion 6*a* and the projections 6*b* are not essential.

(First Protrusions)

As shown in FIGS. 1 to 7, the sole 1 includes a plurality of (seven in the illustrated example) first protrusions 7. The first protrusions 7 are configured to protrude downward from the sole body 2.

The first protrusions 7 are more rigid than the sole body 2. Specifically, examples of the material of the first protrusions 7 include metal materials such as steel materials, aluminum alloys, and titanium alloys, and ceramic materials.

As shown in FIG. 5, each first protrusion 7 has a flat plate shape, and is substantially L-shaped in side view. Specifically, the first protrusion 7 includes an upper portion 10 and a lower portion 11.

The upper portion 10 extends along the lower surface of the outsole 4. In the upper portion 10, a region ranging from a midpoint to front end thereof is integrated with the mount 5, and a region ranging from the midpoint to a rear end thereof is exposed to the outside of the support member 6 (see FIGS. 8 and 9).

The lower portion 11 is formed with an upper end thereof continuous with the front end of the upper portion 10 when viewed in section. The lower portion 11 extends downward from the front end of the upper portion 10. In the lower portion 11, a region ranging from the upper end to midpoint thereof is integrated with the mount 5, and a region ranging from the midpoint to a lower end thereof is exposed to the outside of the support member 6 (see FIGS. 8 and 9). In this embodiment, the lower portion 11 has a constant thickness from the upper end to the lower end when viewed in section.

With the support member 6 embedded in the mount 5, the region of the lower portion 11 ranging from the midpoint to the lower end protrudes downward from the lower surface of the outsole 4. The lower portion 11 is arranged with its front surface 12 facing toward the front side of the sole body 2. The lower portion 11 is formed in a substantially rectangular shape in a front view (see FIGS. 7 and 8).

Figure 10:
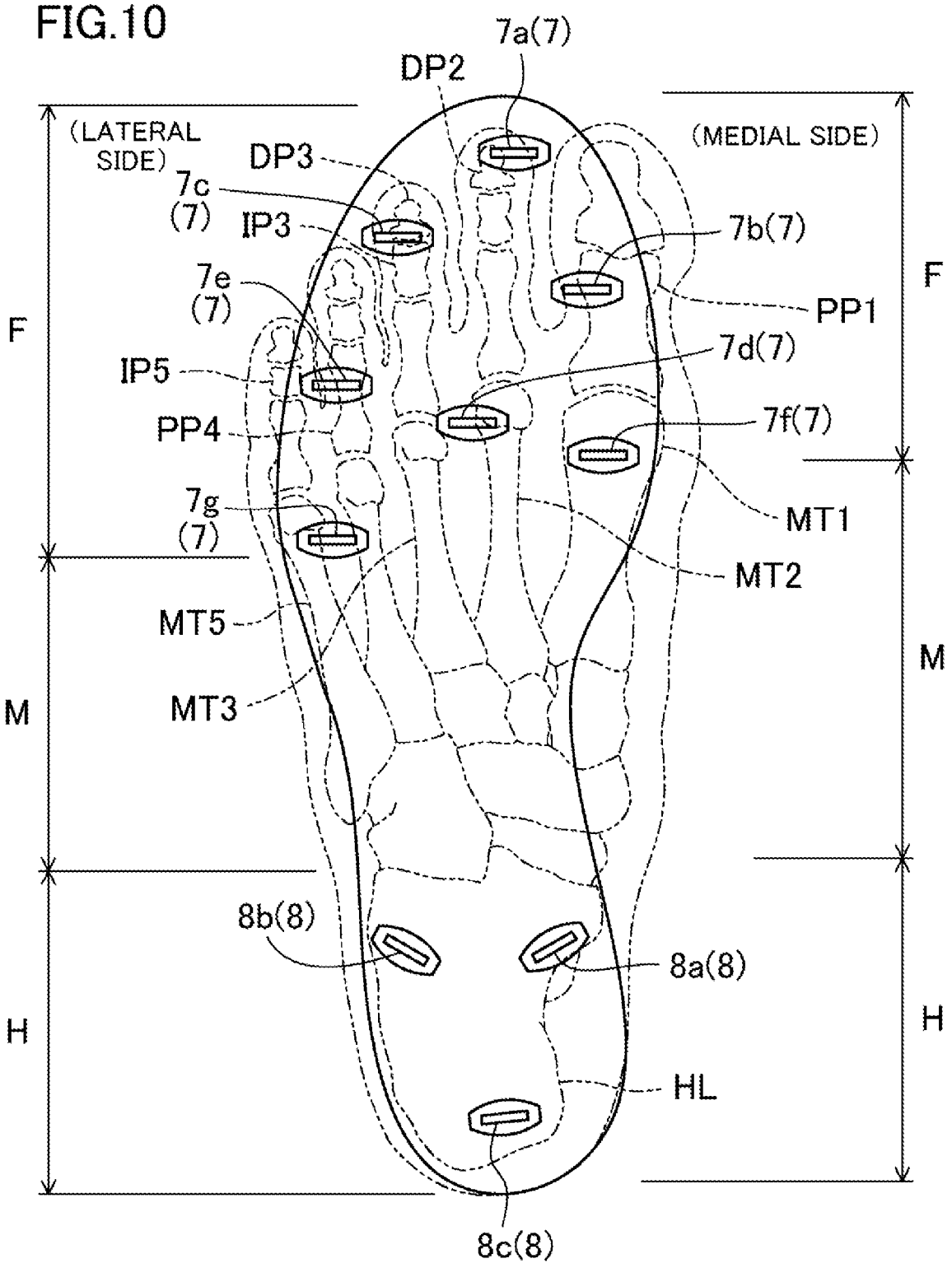
FIG. 10 is a perspective drawing as viewed from above, schematically illustrating the first and second protrusions overlapped with the skeletal structure of the wearer's foot.

As shown in FIG. 10, the plurality of first protrusions 7 are arranged in the forefoot region F of the outsole 4 (sole body 2). In this embodiment, the plurality of first protrusions 7 include first protrusions 7*a* to 7*g*. The first protrusions 7*a* to 7*g* are spaced apart from each other in the forefoot region F.

The first protrusion 7*a* is arranged at the foremost position in the forefoot region F. Specifically, the first protrusion 7*a* is arranged at a position corresponding to the tiptoe of the wearer's foot (the second distal phalanx DP2 in the illustrated example) in the forefoot region F.

The first protrusion 7*b* is arranged at a position corresponding to the big toe of the wearer's foot. Specifically, the first protrusion 7*b* is arranged at a position corresponding to the first proximal phalanx PP1 of the wearer's foot in the forefoot region F.

The first protrusion 7*c* is arranged at a position corresponding to the third toe of the wearer's foot. Specifically, the first protrusion 7*c* is arranged at a position corresponding to the third distal phalanx DP3 and/or the third middle phalanx IP3 of the wearer's foot in the forefoot region F.

The first protrusion 7*d* is arranged substantially at the center of the forefoot region F in the foot width direction. Specifically, the first protrusion 7*d* is arranged at a position corresponding to the distal head of the second metatarsal bone MT2 and/or the distal head of the third metatarsal bone MT3 of the wearer's foot in the forefoot region F.

The first protrusion 7*e* is arranged at a position corresponding to the fourth toe and/or fifth toe of the wearer's foot. Specifically, the first protrusion 7*e* is arranged at a position corresponding to the fourth proximal phalanx PP4 and/or fifth middle phalanx IP5 of the wearer's foot in the forefoot region F.

The first protrusion 7*f* is arranged at the most medial position in the forefoot region F. Specifically, the first protrusion 7*f* is arranged at a position corresponding to the distal head of the first metatarsal bone MT1 of the wearer's foot (i.e., near a position corresponding to the thenar eminence of the foot) in the forefoot region F.

The first protrusion 7*g* is arranged at the most lateral position in the forefoot region F. Specifically, the first protrusion 7*g* is arranged at a position corresponding to the distal head of the fifth metatarsal MT5 of the wearer's foot (i.e., near a position corresponding to the hypothenar eminence of the foot) in the forefoot region F.

As shown in FIGS. 4 and 10, the first protrusions 7 are configured such that the longitudinal direction of the lower portion 11 extends along the foot width direction in a bottom view. Specifically, the lower portion 11 may be configured such that the longitudinal direction is inclined at an angle in a range of 80 degrees or more to 100 degrees or less with respect to the foot length direction in a bottom view.

Here, the lateral width dimension of the first protrusions 7 is preferably 10 mm or more, and more preferably 13 mm or more. This can particularly improve the grip force of the sole 1 with respect to the ground. The lateral width dimension of the first protrusions 7 is preferably 20 mm or less, and more preferably 16 mm or less. This allows the first protrusions 7 to easily stick into the ground.

The number of the first protrusions 7 provided on the sole 1 is preferably five or more, more preferably six or more. This can improve the grip force and the stability of the wearer's foot stepping forward. The number of the first protrusions 7 provided on the sole 1 is preferably nine or less, and more preferably eight or less. This can block the weight of the sole 1 including the plurality of first protrusions 7 from excessively increasing.

(Second Protrusions)

As shown in FIGS. 1 to 4, the sole includes a plurality of (three in the illustrated example) second protrusions 8. The second protrusions 8 protrude downward from the sole body 2.

Similarly to the first protrusions 7, each of the second protrusions 8 is configured as a plate member made of a metal material or a ceramic material, and includes an upper portion 10 and a lower portion 11 (see FIGS. 8 and 9 to which reference is made for the second protrusions 8). The second protrusion 8 is embedded in the mount 5 of the outsole 4 with the upper portion 10 and the lower portion 11 integrated with the support member 6 (see FIG. 6). A region of the lower portion 11 of the second protrusion 8 ranging from a midpoint to a lower end thereof protrudes downward from the lower surface of the outsole 4.

As shown in FIG. 10, the plurality of second protrusions 8 are arranged in the hindfoot region H of the sole body 2. In this embodiment, the plurality of second protrusions 8 include second protrusions 8*a* to 8*c*. The second protrusions 8*a* to 8*c* are spaced apart from each other in the hindfoot region H.

(Characteristic Configuration)

Figure 11:
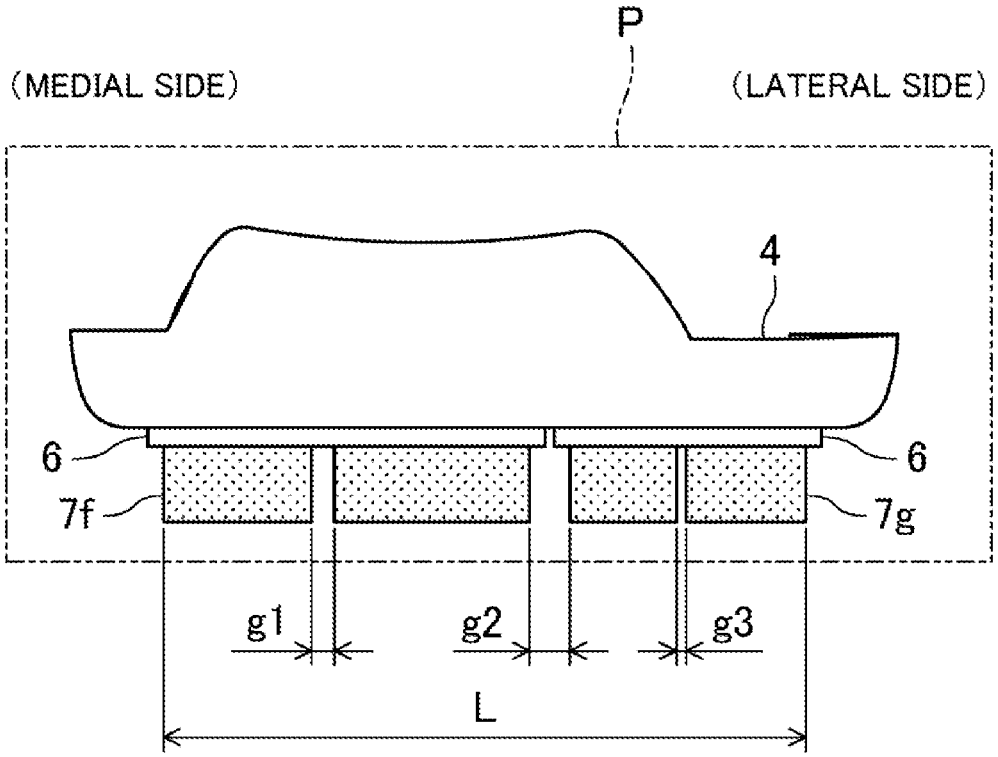
FIG. 11 is a projection view schematically illustrating a forefoot region of the outsole and the first protrusions projected on a virtual projection plane as viewed from the front side of the outsole.

As a characteristic configuration of the embodiment of the present disclosure, when the plurality of first protrusions 7 are projected on a virtual projection plane P (see FIGS. 6 and 7) as viewed from the front side of the outsole 4 (sole body 2) as shown in FIG. 11, the sum of the projection lengths of the first protrusions 7 in the foot width direction is 85% or more and 100% or less of a distance of a straight line (hereinafter referred to as a "linear distance L") connecting in the foot width direction the side of the most medial first protrusion 7*f* to the side of the most lateral first protrusion 7*g* in the forefoot region F. In FIG. 11, the regions of the plurality of first protrusions 7 projected onto the projection plane P are highlighted by dot hatching.

For example, suppose that the linear distance L is 82 mm, and the sum of gaps (g1, g2, and g3 shown in FIG. 11) between the first protrusions 7, 7 in the foot width direction when the first protrusions 7 are projected on the virtual projection plane P as viewed from the front side of the outsole 4 is 7.3 mm. In this case, the sum of the projection lengths in the foot width direction of the first protrusions 7 is 74.7 mm. That is, the sum (74.7 mm) corresponds to about 91.1% of the linear distance L (82 mm), which is 85% or more and 100% or less of the linear distance L. The sum (74.7 mm) does not include the longitudinal dimension of the first protrusions 7 overlapping each other when the first protrusions 7 are projected onto the projection plane P.

ADVANTAGES OF EMBODIMENT

In general, a grip force of the baseball spike shoes with respect to the ground is an important factor for improving a ball speed in the pitching motion. In particular, when the foot opposite to the pitching arm (hereinafter referred to as a "lead foot") steps on the ground, it is desirable to increase the grip force of the shoe applied to the lead foot in consideration of the relationship between a region of the sole of the shoe corresponding to the forefoot of the lead foot and a shear component of a floor reaction force acting on the region in order to improve the ball speed. The "floor reaction force" is a general concept indicating a reaction force generated from a contact portion between the body (mainly the sole) and the floor (ground).

Figure 13:
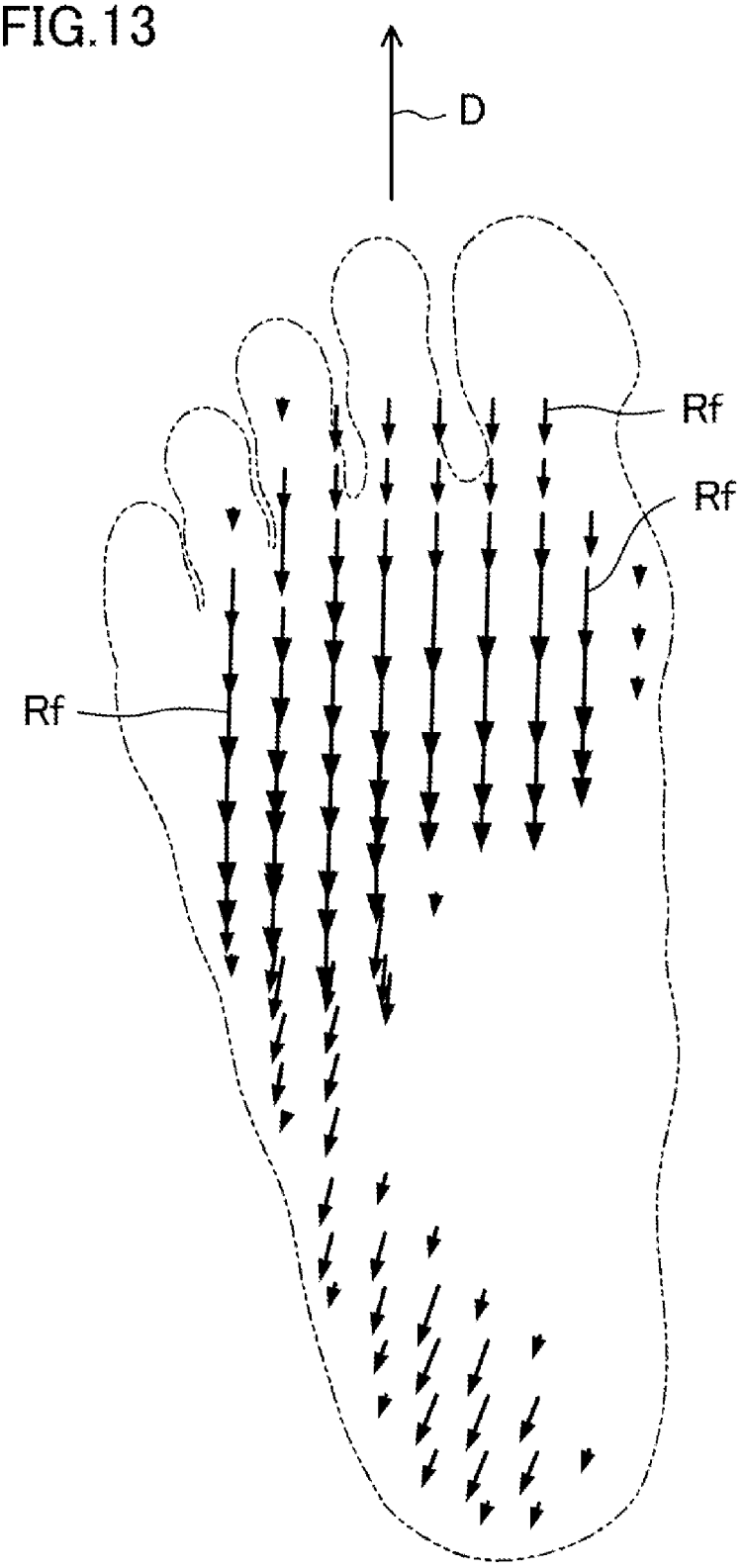
FIG. 13 is a schematic view schematically illustrating the direction of a shear component of a floor reaction force that acts on the sole of a lead foot when the lead foot steps on the ground in the pitching motion.

Specifically, as an ideal motion of the foot during the pitching motion, the lead foot (e.g., the left foot shown in FIG. 12) is desirably brought into contact with the ground in order from the forefoot to the hindfoot, while setting the foot length direction of the lead foot the same as the pitching direction (see arrow D in FIG. 12). In this case, as shown in FIG. 13, a shear component (see arrows Rf shown in FIG. 13) of the floor reaction force toward the direction opposite to the pitching direction (arrow D) acts on the forefoot of the lead foot that steps on the ground. Thus, it has been found in the embodiment of the present disclosure that a specific configuration of the first protrusions 7 may be determined in consideration of the direction of the shear component of the floor reaction force in order to increase the grip force of the sole 1 applied to the lead foot. FIG. 13 schematically shows the shear component of the floor reaction force acting on the lead foot that steps on the ground in the pitching motion. The shear component was measured with a plate-type pressure distribution sensor (product name "emed" manufactured by novel GmbH).

Based on the above findings, the sole 1 is configured such that, when the plurality of first protrusions 7 are projected on the virtual projection plane P as viewed from the front side of the sole body 2, the sum of the projection lengths of the first protrusions 7 in the foot width direction is 85% or more and 100% or less of the linear distance L. According to this configuration, when the foot opposite to the pitching arm (lead foot) steps on the ground, the plurality of first protrusions 7 arranged densely in the foot width direction receive most of the shear component of the floor reaction force acting on the sole 1 applied to the lead foot. That is, the first protrusions 7 are configured to absorb the whole shear component of the floor reaction force toward the direction opposite to the pitching direction. Thus, the shear component of the floor reaction force acting on the forefoot region F increases in the sole 1 applied to the lead foot. This can increase the grip force of the lead foot with respect to the ground. Therefore, the sole 1 according to the embodiment of the present disclosure and the baseball spike shoes S including the sole 1 can improve the ball speed in the pitching motion.

For example, if the ball speed of a baseball pitcher wearing the baseball spike shoes S constantly increases even at 1.0 km/h, it is clear that the impact on the batter will be enhanced. Thus, it can be said that the above-described advantages are sufficiently exerted.

In addition, each of the first protrusions 7 is configured such that its longitudinal direction is inclined at an angle in a range of 80 degrees or more to 100 degrees or less with respect to the foot length direction in a bottom view. In this configuration, with the longitudinal direction of the first protrusions 7 extending substantially along the foot width direction, the front surfaces 12 of the first protrusions 7 easily face toward the front side of the sole body 2. Therefore, when the lead foot steps on the ground, the plurality of first protrusions 7 efficiently receive the shear component of the floor reaction force. This can increase the shear component of the floor reaction force acting on the forefoot region F on the sole 1 applied to the lead foot, and can further increase the grip force.

In addition, the most medial first protrusion 7*f* is arranged near a position corresponding to the thenar eminence of the wearer's foot in the forefoot region F, and the most lateral first protrusion 7*g* is arranged near a position corresponding to the hypothenar eminence of the wearer's foot in the forefoot region F. This can increase the grip force at the positions corresponding to the thenar eminence and hypothenar eminence of the wearer's foot in the forefoot region F. Further, when the lead foot steps on the ground, the sole 1 can be stabilized in the foot width direction with the first protrusions 7*f* and 7*g* serving as fulcrums.

Moreover, the first protrusions 7 made of a metal material or a ceramic material ensure relatively high rigidity. Thus, when the lead foot steps on the ground, the plurality of first protrusions 7 easily stick into the ground, and the sole 1 can be stabilized with respect to the ground.

Each of the first protrusions 7 has a plate shape, and is configured such that the front surface 12 faces toward the front side of the sole body 2. This allows the plurality of first protrusions 7 to efficiently receive the shear component of the floor reaction force when the lead foot steps on the ground. This can increase the shear component of the floor reaction force acting on the forefoot region F, and can further increase the grip force.

The first protrusion 7*a* is arranged at a position corresponding to the tiptoe of the wearer's foot in the forefoot region F. Thus, the first protrusion 7*a* receives the shear component of the floor reaction force from a point of time when the lead foot starts to step on the ground. This can increase the shear component of the floor reaction force acting on the forefoot region F, and can further increase the grip force.

OTHER EMBODIMENTS

It has been described in the above embodiment that the sole body 2 includes the midsole 3 and the outsole 4, but the present disclosure is not limited to this configuration. For example, the sole body 2 may be comprised of the outsole 4.

Although the support members 6 are provided in the above embodiment, the present disclosure is not limited to this configuration. That is, the first protrusions 7 may be integrated with the mounts 5 of the outsole 4 without providing the support members 6. The same applies to the second protrusions 8.

It has been described in the above embodiment that the lower portion 11 of each of the first and second protrusions 7 and 8 has a flat plate shape, but the present disclosure is not limited thereto. For example, the lower portion 11 may be slightly curved or bent forward or backward at its substantial center in the foot width direction in a bottom view.

Figure 14:
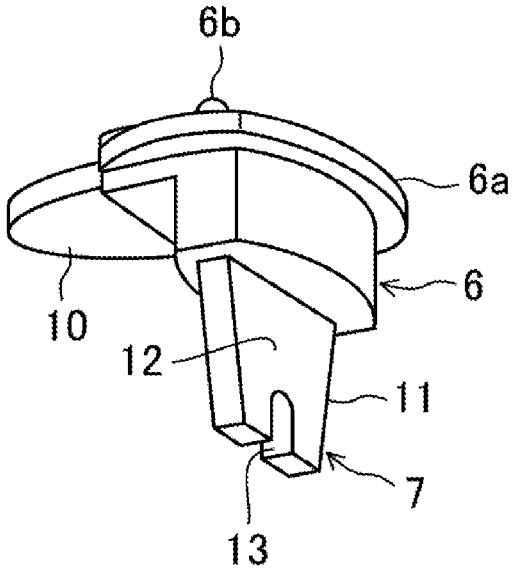
FIG. 14 is a view corresponding to FIG. 8, illustrating a first protrusion (or a second protrusion) according to another embodiment.

It has been described in the above embodiment that the lower portion 11 of each of the first and second protrusions 7 and 8 has a substantially rectangular shape in a front view, but the present disclosure is not limited thereto. For example, as shown in FIG. 14, the lower portion 11 may have an inverted trapezoidal shape tapered from an upper end to a lower end in a front view. The lower portion 11 may be provided with at least one notch 13 cut from the lower end in a front view.

It has been described in the above embodiment that the lower portion 11 has a constant thickness from the upper end to the lower end, but the present disclosure is not limited thereto. For example, the lower portion 11 may be formed such that a region ranging from the midpoint to the lower end is thicker than a region ranging from the upper end to the midpoint.

In the above-described embodiment, the plurality of first protrusions 7 are arranged in the forefoot region F of the sole body 2, and the plurality of second protrusions 8 are arranged in the hindfoot region H of the sole body 2. However, the present disclosure is not limited thereto. For example, third protrusions (not shown) having the same configuration as the first protrusions 7 may be arranged in the midfoot region M (see FIG. 10) of the sole body 2.

Although the embodiments of the present disclosure have been described above, the present disclosure is not limited to the above embodiments, and various modifications can be made within the scope of the present disclosure.

The present disclosure is industrially usable as a baseball spike shoe applicable to a foot opposite to a pitching arm.

What is claimed is:

1. A sole of a baseball spike shoe applicable to a foot opposite to a pitching arm, the sole comprising:

a sole body; and a plurality of first protrusions each of which is more rigid than the sole body and configured to protrude downward from the sole body, wherein the plurality of first protrusions are arranged in a forefoot region of the sole body corresponding to a forefoot of a wearer's foot such that the plurality of first protrusions are arranged in a position corresponding to:

a first proximal phalanx, a second distal phalanx, a third distal phalanx and a third middle phalanx, a distal head of a second metatarsal bone and a distal head of a third metatarsal bone, a fourth proximal phalanx and a fifth middle phalanx, a distal head of a first metatarsal bone, and a distal head of a fifth metatarsal bone of the wearer's foot in the forefoot region, all of the plurality of first protrusions being formed such that a longitudinal direction of each first protrusion extends along a foot width direction, the foot width direction generally extending in a direction from a medial side to a lateral side of the sole body in a bottom view, wherein, in the bottom view, all of the plurality of first protrusions are configured such that an angle between the longitudinal direction of each first protrusion and a line extending between a front end and a rear end of the sole body is inclined at an angle in a range of 80 degrees or more to 100 degrees or less, wherein a most medial first protrusion is arranged near a position corresponding to a thenar eminence of the wearer's foot in the forefoot region, and wherein a most lateral first protrusion is arranged near a position corresponding to a hypothenar eminence of the wearer's foot in the forefoot region, wherein the number of the plurality of first protrusions is nine or less, when all of the plurality of first protrusions are projected on a virtual projection plane extending from the medial side to the lateral side of the sole body as viewed from a front side of the sole body, a sum of projection lengths of the plurality of first protrusions in the foot width direction is 85% or more and 100% or less of a distance of a straight line connecting in the foot width direction a side of the most medial one of the first protrusions to a side of the most lateral one of the first protrusions, wherein the first protrusions are projected on the virtual projection plane such that portions of the plurality of first protrusions that overlap with each other are excluded from the projection lengths, and wherein each of the plurality of first protrusions has a plate shape and is configured such that its front surface faces toward the front side of the sole body.

2. The sole of claim 1, wherein each of the plurality of first protrusions is made of a metal material or a ceramic material.

3. The sole of claim 1, wherein a foremost one of the first protrusions is arranged at a position corresponding to a tiptoe of the wearer's foot in the forefoot region.

4. A baseball spike shoe comprising the sole of claim 1.

* * * * *